US007575619B2

(12) United States Patent
Kawata et al.

(10) Patent No.: US 7,575,619 B2
(45) Date of Patent: Aug. 18, 2009

(54) WEAR RESISTANT SINTERED MEMBER

(75) Inventors: Hideaki Kawata, Matsudo (JP); Hiroki Fujitsuka, Matsudo (JP)

(73) Assignee: Hitachi Powdered Metals Co., Ltd., Matsudo (JP)

( * ) Notice: Subject to any disclaimer, the term of this patent is extended or adjusted under 35 U.S.C. 154(b) by 501 days.

(21) Appl. No.: 11/387,887

(22) Filed: Mar. 24, 2006

(65) Prior Publication Data

US 2006/0219054 A1 Oct. 5, 2006

(30) Foreign Application Priority Data

Mar. 29, 2005 (JP) ..... 2005-096359

(51) Int. Cl.
*C22C 33/02* (2006.01)

(52) U.S. Cl. ..... 75/246; 75/230

(58) Field of Classification Search ..... 75/230, 75/246

See application file for complete search history.

(56) References Cited

U.S. PATENT DOCUMENTS

| | | | |
|---|---|---|---|
| 5,080,713 | A | 1/1992 | Ishibashi et al. |
| 5,259,860 | A | 11/1993 | Ikenoue et al. |
| 5,534,220 | A | 7/1996 | Purnell et al. |
| 5,824,922 | A | 10/1998 | Aonuma et al. |
| 5,870,989 | A | 2/1999 | Takahashi et al. |
| 5,949,003 | A | 9/1999 | Aoki et al. |
| 6,251,157 | B1 | 6/2001 | Aoki et al. |
| 6,340,377 | B1 | 1/2002 | Kawata et al. |
| 2005/0132842 | A1 | 6/2005 | Kawata et al. |

FOREIGN PATENT DOCUMENTS

| | | |
|---|---|---|
| DE | 689 26 758 T2 | 10/1996 |
| DE | 697 05 289 T2 | 11/2001 |
| JP | A 53-112206 | 9/1978 |
| JP | A-04-157138 | 5/1992 |
| JP | A-04-157139 | 5/1992 |
| JP | B2-5-55593 | 8/1993 |
| JP | A-07-278725 | 10/1995 |
| JP | A-09-195012 | 7/1997 |
| JP | A-2000-064002 | 2/2000 |
| JP | A-2002-332552 | 11/2002 |
| JP | A-2002-356704 | 12/2002 |
| JP | A-2005-154798 | 6/2005 |

*Primary Examiner*—Roy King
*Assistant Examiner*—Ngoclan T Mai
(74) *Attorney, Agent, or Firm*—Oliff & Berridge, PLC

(57) ABSTRACT

A wear resistant sintered member comprising an Fe base alloy matrix and a hard phase dispersed in the Fe base alloy matrix and having an alloy matrix and hard particles precipitated and dispersed in the alloy matrix. Manganese sulfide particles having particle size of 10 μm or less are uniformly dispersed in crystal grains of the overall Fe base alloy matrix, and manganese sulfide particles having particle size of 10 μm or less are dispersed in the alloy matrix of the hard phase.

19 Claims, 3 Drawing Sheets

WEAR RESISTANT SINTERED MEMBER

BACKGROUND OF THE INVENTION

1. Field of the Invention

The present invention relates to a wear resistant sintered member of which a machinability can be improved without causing decrease in strength thereof, and relates to a production method therefore. The present invention is preferably used for members, for example, valve seats of internal combustion engines which are required to have machinability as well as wear resistance.

2. Description of the Related Art

Wear resistant sintered members produced by powder metallurgy method are applied to various kinds of sliding members since desired various kinds of hard phases which cannot be produced by a typical casting method can be dispersed in a desired matrix. For example, as disclosed in Japanese Examined Patent Application Publication No. H05-055593 (hereinafter referred to as "Patent Publication 1"), 5 to 25 mass % of a hard phase consisting of 26 to 30 mass % of Mo; 7 to 9 mass % of Cr; 1.5 to 2.5 mass % of Si; and the balance of Co is dispersed in a matrix. A large number of combinations of hard phase such as the above and various kinds of matrixes have been proposed.

The wear resistant sintered alloy disclosed in the Patent Publication 1 includes expensive Co in the matrix and the hard phase. In order to meet cost performance, a wear resistant sintered alloy not including expensive Co is proposed and used in Japanese Unexamined Patent Application Publication No. H09-195012 (hereinafter referred to as "Patent Publication 2"). The hard phase in the Patent Publication 2 uses a hard phase forming powder consisting of 4.0 to 25 mass % of Cr and 0.25 to 2.4 mass % of C as an essential elements; and the balance of Fe and inevitable impurities. In the sintered alloy, the hard phase optionally includes at least one element selected from a group consisting of 0.3 to 3.0 mass % of Mo; 0.2 to 2.2 mass % of V; and 1.0 to 5.0 mass % of W. In the hard phase using the above hard phase forming powder, hard particles mainly composed of Cr carbides are precipitated in a portion of the initial hard phase forming powder, and Cr in the hard phase forming powder is diffused in the matrix. As a result, the hardenability of Fe matrix is improved, whereby the matrix is transformed to martensite. Furthermore, the hard phase has a structure of ferrite including Cr rich portion proximate to the initial hard phase forming powder. That is, the Cr carbide particles improving wear resistance are precipitated at a portion of the initial hard phase forming powder, and the Cr carbide particles are covered with Cr rich ferrite, so that removal of the Cr carbide particles is prevented. Furthermore, the Cr rich ferrite is surrounded by martensite, whereby wear resistance of the matrix is improved. A large number of wear resistant sintered alloys in combinations of hard phase in Patent Publication 2 and various kinds of matrixes have been proposed, and wear resistant sintered alloys applying the hard phase in Patent Publication 1 have been proposed.

Various hard phases have been proposed such as the above to improve wear resistance of the sintered alloy. In order to meet high efficiency of internal combustion engines in recent years, a hard phase forming alloy powder and a wear resistant sintered member using the powder are proposed in Japanese Unexamined Patent Application Publication No. 2002-356704 (hereinafter referred to as "Patent Publication 3") and Japanese Unexamined Patent Application Publication No. 2005-154798 (hereinafter referred to as "Patent Publication 4"). Patent Publication 3 discloses an improvement of the hard phase in Patent Publication 1 and a variation of the hard phase in Patent Publication 1 in which the matrix of the hard phase is changed to Fe. In Patent Publication 3, a wear resistant hard phase forming alloy powder includes: 1.0 to 12 mass % of Si; 20 to 50 mass % of Mo; 0.5 to 5.0 mass % of Mn; and the balance of at least one element selected from the group consisting of Fe, Ni, and Co and inevitable impurities. In Patent Publication 3, the matrix includes Mn in the above manner, whereby the matrix is strengthened, the hard phase is securely adhered to the matrix, and wear resistance is improved.

Patent Publication 4 discloses improvement of the hard phase in Patent Publication 1. In Patent Publication 4, the hard phase forming alloy powder includes: 48 to 60 mass % of Mo; 3 to 12 mass % of Cr; 1 to 5 mass % of Si; and the balance of Co and inevitable impurities. In Patent Publication 4, the Mo content is increased to increase amount of precipitated Mo silicide and to form a Mo silicide group, whereby plastic flow and adhesion of the alloy are inhibited as small as possible, and wear resistance is improved.

As described above, in order to meet requirements of high output of internal combustion engines, hard phases for wear resistant sintered members have been improved, and wear resistance has been improved. Although the above wear resistant sintered members can be formed in near net shape, in some sliding members, it is necessary to machine to meet highly precise dimensions. For example, a valve seat used in an internal combustion engine is press-fitted into a head of an engine and is used. The valve seat is required to be coaxial with a valve guide which is press-fitted in the same manner as the valve seat. The valve seat and the valve guide are machined together by a tool to be coaxial with the valve guide, wherein the tool has a cutting tool integrally equipped with a cutting tool for machining the valve guide and a cutting tool for machining the valve seat. The wear resistant sintered member such as above has low machinability due to the wear resistance, and is difficult to be machined. Therefore, in order to improve the machinability of the wear resistant sintered member, various techniques for improvement of the wear resistant sintered member have been proposed and used.

As disclosed in claims 4 and 9 in Patent Publication 2, and in claim 5 in Patent Publication 3 as the most typical techniques, a powder for improving machinability, a MnS powder, or the like, is added and mixed with a raw material powder, and particles for improving machinability, MnS particles, or the like, are dispersed in pores and powder particle boundaries of the sintered alloy. Japanese Unexamined Patent Application Publication No. H04-157139 (hereinafter referred to as "Patent Publication 5") proposes a typical technique in which at least one material for improving machinability is selected from the group consisting of a meta-magnesium silicate type mineral and an ortho-magnesium silicate type mineral, and is used together with at least one material selected from the group consisting of boron nitride and manganese sulfide. The above new materials for improving machinability have cleavage, hereby improving machinability. In Japanese Unexamined Patent Application Publication No. H04-157138 (hereinafter referred to as "Patent Publication 6"), the technique disclosed in Patent Publication 4 is applied to the alloy disclosed in the Patent Publication 1.

A different technique from the above techniques for improving machinability is proposed. In Japanese Unexamined Patent Application Publication No. 2000-064002 (hereinafter referred to as "Patent Publication 7"), the hard phase forming powder disclosed in the Patent Publication 2 is used together with at least one sulfide powder selected from the group consisting of a $MoS_2$ powder, a $WS_2$ powder, a FeS powder, and a CuS powder. The sulfide powder is decomposed in sintering, and Cr sulfide are precipitated as well as Cr carbides, whereby wear resistance and machinability of the hard phase are improved. In Japanese Unexamined Patent Application Publication No. 2002-332552 (hereinafter referred to as "Patent Publication 8"), a metal sulfide powder including 0.04 to 5 mass % of S is mixed with a steel powder including 0.1 to 8 mass % of Mn. The mixed powder is compacted into a green compact in a die, and the green compact is sintered at a temperature of from 900 to 1300° C., so that a sintered member is obtained. The sintered member is uniformly precipitated and dispersed with 0.15 to 10 mass % of MnS particles with particle size of 10 μm or less in grains of the overall matrix. Patent Publication 8 mentions that machinability is improved by precipitating the sulfide, the technique can be used in combination with the above technique in which the material for improving machinability is added to the raw material powder, and the machinability can be greatly improved by the above combination.

As described above, in accordance with the recent requirements, wear resistance has been improved greatly, and machinability has been improved by various techniques. However, in recent years, machinability is required to be improved more greatly, and only the above techniques for improving machinability cannot meet the present requirements. That is, in Patent Publication 8, as shown in FIG. 2, MnS is precipitated in only the Fe base alloy matrix. Therefore, the machinability is insufficient for the hard phase which becomes harder in viewpoints of improving wear resistance disclosed in Patent Publications 3 and 8.

SUMMARY OF THE INVENTION

An object of the present invention is to provide a wear resistant sintered member having high wear resistance and high machinability. An object of the present invention is to provide a production method for the wear resistant sintered member.

In order to solve the above problems, the inventors researched a wear resistant sintered member based on the above Patent Publication 8. The inventors found that as shown in FIG. 1, Mn sulfide is dispersed not only in an Fe base alloy but also in a hard phase, so that the machinability of the hard phase is improved, and machinability of the wear resistant sintered member can thereby be improved. The inventors found production conditions in which Mn sulfide can be reliably formed. That is, kinds of sulfides which are easily decomposed in sintering are determined for supplying S for bonding Mn of the matrix and the hard phase. The inventors found that size of a sulfide powder influences on decomposition of the sulfide, and the size is determined so that Mn sulfide is reliably formed. The inventors confirmed that in the wear resistant sintered member obtained in the above manner, Mn sulfide is precipitated not only in a matrix but also in a hard phase, and the machinability of the wear resistant sintered member can be improved.

The present invention was made based on the above findings. The present invention provides a wear resistant sintered member comprising an Fe base alloy matrix and a hard phase dispersed in the Fe base alloy matrix, wherein the hard phase has an alloy matrix and hard particles precipitated and dispersed in the alloy matrix. In the invention, manganese sulfide particles having particle size of 10 μm or less are uniformly dispersed in crystal grains of the overall Fe base alloy matrix, and manganese sulfide particles having particle size of 10 μm or less are dispersed in the alloy matrix of the hard phase.

The wear resistant sintered member can be produced by the following method. The method comprises preparing: a matrix forming steel powder including 0.2 to 3 mass % of Mn; a hard phase forming alloy powder including 0.5 to 5 mass %; a sulfide powder including S of which percentage is 0.04 to 5 mass % in overall composition; and at least one sulfide powder selected from the group consisting of a molybdenum disulfide powder, a tungsten disulfide powder, an iron sulfide powder, and a copper sulfide powder. The matrix forming steel powder, the hard phase forming alloy powder, and the sulfide powder are mixed and compacted into a green compact in a die, and the green compact is sintered at a temperature of from 1000 to 1300° C.

In the first aspect of the present invention, the fine Mn sulfide is dispersed not only in the matrix but also in the hard phase, so that the machinability of the wear resistant sintered member can be improved more greatly than in the conventional techniques. In the second aspect of the present invention, the above Mn sulfide is reliably precipitated, and the machinability of the wear resistant sintered member can be reliably improved.

DETAILED DESCRIPTION FOR THE INVENTION

Figure 1:
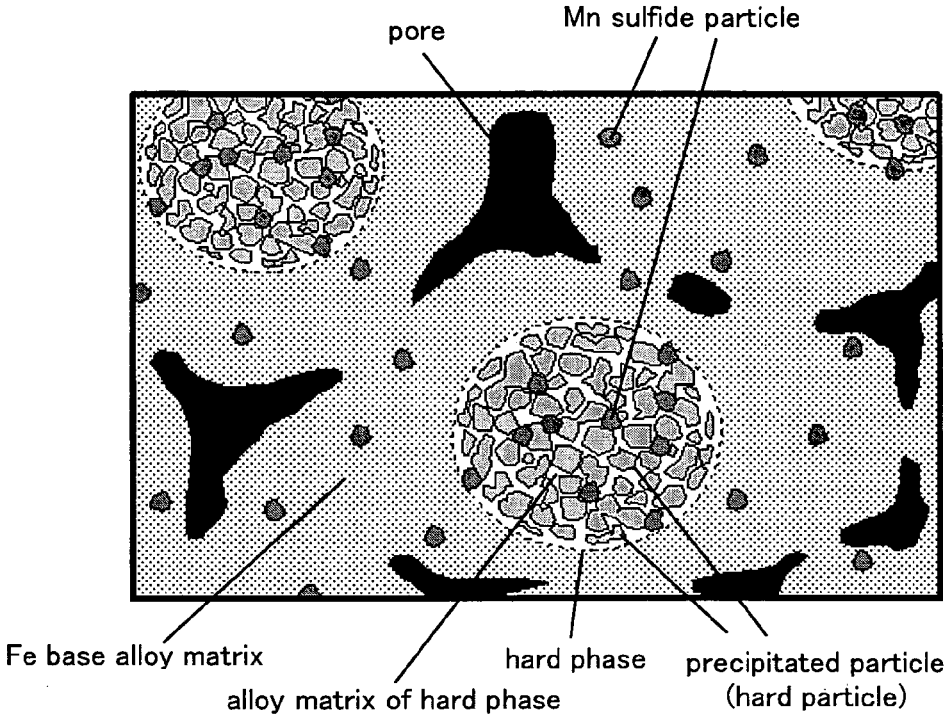
FIG. 1 is a schematic diagram showing a metal structure of a wear resistant sintered member of an embodiment according to the present invention.
Figure 2:
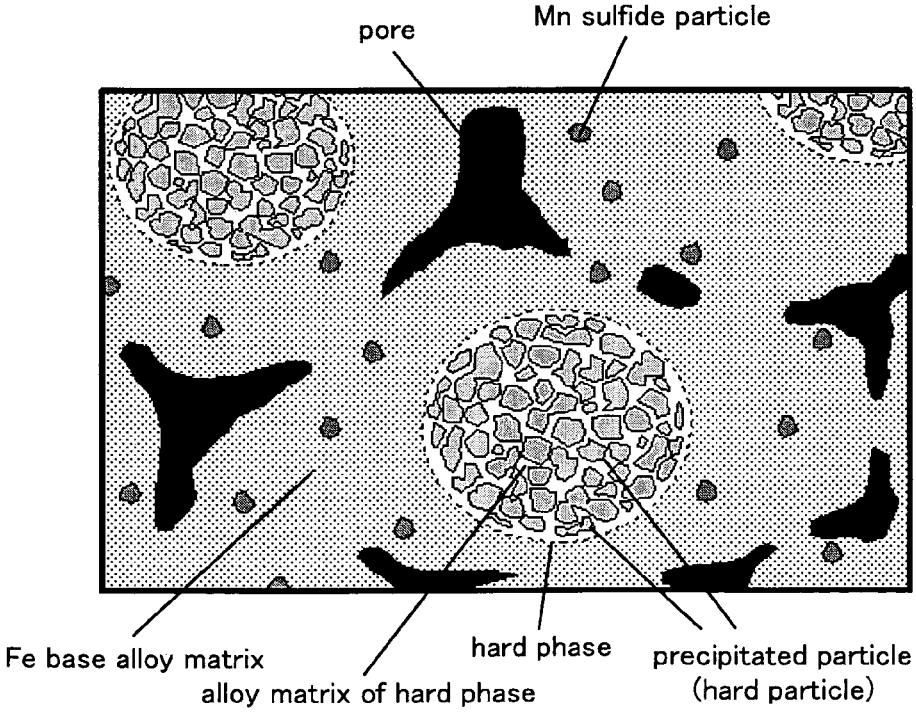
FIG. 2 is a schematic diagram showing a metal structure of a conventional wear resistant sintered member.

In the present invention, Mn is solid-solved to a matrix and a hard phase (alloy matrix of a precipitation dispersion type hard phase) respectively, Mn is reacted with S which is supplied by decomposing a sulfide powder, whereby a fine Mn sulfide is precipitated in the matrix and the hard phase as shown in FIG. 1. In this case, if the size of the precipitated manganese sulfides is large, the manganese sulfides are segregated and machinability cannot be obtained uniformly. Therefore, the size of the precipitated manganese sulfides should be 10 μm or less.

All metal sulfides have been considered chemically stable. However, as disclosed in Patent Publications 7 and 8, it was confirmed that some metal sulfides are decomposed in sintering. In Reference 1 (Chemical Unabridged Dictionary, $9^{th}$ Edition, Published by Kyoritsu Shuppan Co., Ltd, Mar. 15, 1964), there is the following description. That is, manganese sulfide (MnS) has a high melting point of 1610° C. among metal sulfides. When MnS is heated together with a $H_2$ gas, MnS is not eroded by the $H_2$ gas. Thus, MnS is difficult to be decomposed. Chrome sulfide (CrS) has a high melting point, and is not reduced by hydrogen even at a temperature of 1200° C. Thus, CrS is difficult to be decomposed.

On the other hand, according to the Reference 1, when molybdenum disulfide ($MoS_2$) is heated in a electric furnace, molybdenum disulfide is changed to metal molybdenum via $Mo_2S_3$. When $MoS_2$ is heated in air at 550° C., $MoS_2$ reacts with $O_2$, thereby being decomposed to molybdenum trioxide ($MoO_3$) and sulfur dioxide ($SO_2$). $MoS_2$ reacts with water vapor in red heat. Thus, $MoS_2$ is easily decomposed. When tungsten disulfide ($WS_2$) is heated in vacuum, $WS_2$ is decomposed from at 1100° C., and is changed to tungsten at 800° C. Thus, $WS_2$ is easily decomposed. When iron sulfide (FeS) is heated in air at about 200° C., FeS is changed to iron oxide. When FeS is super-heated in a flow of $H_2$ gas, FeS is changed to Fe. When FeS is heated together with carbon at 1200° C. or more, Fe and $CO_2$ are formed. Thus, FeS is easily decomposed. When copper sulfide (CuS) is heated, CuS begins decomposition at 220° C., and then $CuS_2$ and S are formed. Thus, CuS is easily decomposed.

It is described in Reference 1 that the above molybdenum disulfide, tungsten disulfide, iron sulfide, and copper sulfide are easily decomposed in a specific condition. It is conceived that, in actual sintering process, the above sulfides are decomposed when decomposition condition is satisfied by water, oxygen, and hydrogen included in an atmosphere, and by water and oxygen which are absorbed to a surface of an iron powder. The condition disclosed in the Reference 1 is a decomposition condition when a sulfide exists as a simple substance. In sintering a mixture of a metal powder and a sulfide powder, the sulfide reacts with an activated metal surface at a high temperature, and the activated metal surface functions as a catalyst, so that decomposition of the sulfide may be promoted. In the present invention, a powder of the above easily decomposing molybdenum disulfide, tungsten disulfide, iron sulfide, and copper sulfide is added to a raw material powder, whereby, the sulfide powder is decomposed in sintering, and S is reliably supplied to the matrix and the hard phase. It should be noted that metal compositions supplied by decomposition of the sulfide powder are dispersed in the matrix and strengthen it. In particular, molybdenum disulfide powder is preferably used among the above sulfide powders.

In order to precipitate and disperse sulfide particles sufficiently in the matrix and the hard phase by using the above sulfide powders, the sulfide powder should include 0.04 mass % or more of S in the overall composition. When excessive amount of the sulfide powder is added to the matrix and the hard phase, amount of the remained pores increases after decomposition of the sulfide, so that the strength of the wear resistant sintered member is decreased and the wear resistance thereof is lowered. Therefore, the upper limit of the amount of S should be 5 mass % in the overall composition.

In order to completely decompose a sulfide powder added to a raw material powder in sintering, the sintering temperature should be 1000° C. or more. In this temperature range, the sulfide powder reacts with the surface of the metal powder activated in the sintering process, and the sulfide powder is reliably decomposed. When sintering is performed at 1300° C. or more, the furnace is damaged with economical loss. Therefore, the sintering temperature should be 1300° C. or less.

In order to completely decompose the sulfide powder added to the raw material powder in sintering, particle size of the sulfide powder is important. That is, since decomposition reaction is activated at a portion of the metal powder contacting the sulfide powder, when the sulfide powder has a large size, the decomposition reaction is insufficient at a portion of the sulfide powder, amount of S supplied to the matrix and the hard phase is uneven, and amount of manganese sulfide precipitated in the matrix and the hard phase is not reliable. Therefore, in order to avoid such problems, the particle size of the sulfide powder is preferably small. For example, when the maximum particle size is 100 μm or less, and the average size is 50 μm or less, the added sulfide powder is reliably decomposed, and the manganese sulfide can be reliably formed. When the sulfide powder has a large particle size, an initial powder portion of the sulfide powder remains as coarse Kirkendall pores after the sulfide powder was decomposed and disappeared, so that the initial powder portion causes decrease in strength and wear resistance.

In decomposition of the sulfide powder, sintering atmosphere greatly influences on the decomposition. In order to activate the surface of the metal powder, the sintering should be performed in vacuum or an atmosphere of a gas having a dew point of −10° C. or less of a decomposition ammonia gas, a nitride gas, a hydrogen gas, or an argon gas. As a result, the surface of the metal powder is clean and is activated, and the sulfide powder can be reliably decomposed. When the sintered atmosphere contains oxygen to certain extent, the surface of the metal powder is oxidized, thereby being not activated, and S generated by decomposition of the sulfide powder is bonded with oxygen, so that harmful $SO_x$ is easily formed.

A precipitation dispersion hard phase is suitable for the hard phase of the present invention. For example, the Mo silicide precipitation type hard phase used in Patent Publications 1, 3 and 4, the Cr carbide precipitation type hard phase used in Patent Publication 2, and high speed steel type hard phase (in which W, Mo, or Cr carbide is precipitated) used in the conventional techniques can be used. In the present invention, Mn is solid-solved to an alloy matrix of the above precipitation dispersion type hard phase, S is supplied by decomposing the sulfide powder in sintering, and Mn is bonded with S, so that fine particles of manganese sulfide having a particle size of 10 μm or less are formed in crystal grains. The Co base alloy used in Patent Publications 1, 3 and 4 or the Fe base alloy used in Patent Publications 2 and 3 can be used for the alloy base matrix of the precipitation dispersion type hard phase.

The ability of forming sulfide relates to electro-negativity, and S is easily bonded with an element having low electro-negativity and sulfides are formed. The electro-negativity of each element is arranged in a magnitude thereof as follows. Each numeral in round brackets denotes the electro-negativity of the element.

$$Mn(1.5)<Cr(1.6)<Fe, Ni, Co, Mo(1.8)<Cu(1.9)$$

Since Mn is the most easily bonded with S, manganese sulfides are preferentially precipitated. The above order corresponds to the description of the Reference 1.

The above precipitation dispersion type hard phase can be easily formed by adding an alloy powder having alloyed components for forming hard phase to a raw material powder. Although the hard phase forming alloy powder is hard, amount of the hard phase forming alloy powder is smaller than that of a matrix forming steel powder. Therefore, when the hardness of the hard phase forming alloy powder is increased by including Mn, the influence on compactability of the raw material powder is small. Since hard particles are precipitated in the hard phase, machinability of the hard phase is deteriorated. In order to improve machinability of the hard phase, amount of the manganese sulfides included in the hard phase should be larger than that of the matrix. Therefore, amount of Mn solid-solved in a portion of the hard phase (alloy matrix portion of the precipitation dispersion type hard phase) is 0.5 mass % or more, so that the manganese sulfides are precipitated in the portion of the hard phase and the machinability of the hard phase is improved. When amount of Mn is excessive, the hardness of the hard phase forming alloy powder increases, and the compactability of the powder is lowered. Therefore, amount of Mn should be 5 mass % or less in the hard phase forming alloy powder.

Specifically, when a Mo silicide precipitation type hard phase is formed, a hard phase forming alloy powder preferably includes: 10 to 50 mass % of Mo; 0.5 to 10 mass % of Si;

0.5 to 5 mass % of Mn; and the balance of Fe or Co, and inevitable impurities. When a Cr carbide precipitation type hard phase is formed, an alloy powder preferably includes: 4 to 25 mass % of Cr; 0.5 to 5 mass % of Mn; 0.25 to 2.4 mass % of C; the balance of Fe and inevitable impurities. In this case, if necessary, the alloy powder includes at least one selected from the group consisting of 0.3 to 3 mass % of Mo, 0.2 to 2.2 mass % of V (vanadium), and 1 to 5 mass % of W. A graphite powder for forming Cr carbide is preferably supplied to a raw material powder together with the above alloy powder at a predetermined amount at the same time. When a high speed steel type hard phase is formed, a hard phase forming alloy powder includes: 3 to 5 mass % of Cr; 1 to 20 mass % of W; 0.5 to 6 mass % of V; 0.5 to 5 mass % of Mn; 0.6 to 1.7 mass % of C; the balance of Fe and inevitable impurities. In this case, the alloy powder optionally includes 20 mass % or less of at least one of Mo and Co. A graphite powder for forming Cr carbide, W carbide, V carbide, or Mo carbide is preferably supplied to a raw material powder together with the above alloy powder at a predetermined amount at the same time.

In viewpoints of wear resistance of the wear resistant sintered member, the raw material powder preferably includes 2 to 40 mass % of the hard phase forming alloy powder, and the wear resistant sintered member includes 2 to 40 mass % of the precipitation dispersion type hard phase dispersed therein. That is, when amount of the dispersed hard phase is less than 2 mass %, improvement of the wear resistance is insufficient. When amount of the dispersed hard phase exceeds 40 mass %, the strength of the wear resistant sintered member is decreased and the wear resistance thereof is lowered.

It is well known that Mo silicide has a self-lubricity. In this regard, among the precipitation dispersion type hard phases, Mo silicide precipitation type hard phase is preferable in consideration with attack on contacting member and self-wear resistant.

As disclosed in Patent Publication 8, Mn is solid-solved to a matrix of the wear resistant sintered member, S is formed by decomposing the sulfide powder in sintering, and Mn of the alloy matrix is bonded with S, so that fine particles of manganese sulfide having a particle size of 10 μm or less are formed in crystal grains. In order to reliably precipitate the manganese sulfides, amount of Mn solid-solved in the matrix should be 0.2 mass % or more. In the wear resistant sintered member in which hard particles are dispersed in the matrix, the hard phase forming alloy powder is harder than the matrix forming steel powder. Therefore, in order to maintain compactabilty of the raw material powder, compactabilty of the matrix forming steel powder which occupies a large portion of the raw material powder should be improved in comparison with the sintered member in which hard phase is not dispersed. Therefore, amount of Mn solid-solved in the matrix forming steel powder should be inhibited in comparison with the sintered member in which hard phase are not dispersed. Specifically, when more than 3 mass % of Mn is supplied to the matrix forming steel powder, the hardness of the matrix forming steel powder is increased, and the compactabilty of the overall raw material powder is deteriorated. Therefore, amount of Mn supplied to the matrix forming steel powder should be 3 mass % or less.

As described above, amount of Mn added to the matrix forming steel powder is 0.2 to 3 mass %, and amount of Mn added to the hard phase forming alloy powder is 0.5 to 5 mass %. In viewpoints of the machinability of the wear resistant sintered member, a large amount of manganese sulfides should be supplied to the hard phase which is hard and has low machinability. Therefore, amount of Mn included in the hard phase forming alloy powder is preferably larger than amount of Mn included in the matrix forming steel powder.

Regarding the Fe base alloy matrix of the wear resistant sintered member, the Fe base alloy matrix should be composed of bainite in viewpoints of wear resistance of the wear resistant sintered member and attack on a contacting member and in viewpoints of the strength thereof. In order to form the matrix into bainite, it is effective that alloy elements of Mo, Ni, Cr, etc. are added to the matrix. In order to obtain the above effects uniformly in the overall the matrix, an Fe alloy powder in which the above alloy components are alloyed with Fe is preferably used. For example, an alloy powder including 0.5 to 4.5 mass % of Ni; 0.5 to 5.0 mass % of Mo; 0.1 to 3.0 mass % of Cr; 0.2 to 3.0 mass % of Mn; and the balance of Fe and inevitable impurities is used as the matrix forming steel powder. That is, when an alloy powder including less than 0.5 mass % of Ni; less than 0.5 mass % of Mo; less than 0.1 mass % of Cr is used as the matrix forming steel powder, the matrix is insufficiently formed into a bainite. When an alloy powder including more than 4.5 mass % of Ni is used as the matrix forming steel powder, the matrix is sufficiently quenched, so that a portion of the matrix is formed into a hard martensite. Therefore, wear of the contacting member sliding with respect to the wear resistant sintered member is promoted. When an alloy powder including more than 3.0 mass % of Cr is used as the matrix forming steel powder, a passive film of Cr is formed on a surface of the alloy powder, so that sintering property is deteriorated. As a result, the strength and the wear resistance of the wear resistant sintered member are lowered. When an alloy powder including more than 4.5 mass % of Ni; more than 5.0 mass % of Mo; more than 3.0 mass % of Cr is used as the matrix forming steel powder, the hardness of the alloy powder increases, so that the compactability thereof is deteriorated. As a result, the strength and the wear resistance of the wear resistant sintered member is lowered.

In the wear resistant sintered member, the hard phase is dispersed in the Fe base alloy matrix, a portion of components of the hard phase forming alloy powder is dispersed in the matrix forming steel powder, and a portion of the Fe base alloy matrix proximate to the hard phase is formed into a structure other than bainite. However, this case cannot be prevented, thereby being allowable. That is, it is unnecessary that the overall matrix is composed of bainite, and it is preferable that the most portion of the matrix is composed of bainite, and by adding a Ni powder, etc., metal structures (in this case, martensite and austenite) different from bainite being not formed.

The graphite powder supplied to the raw material powder increases the strength of the matrix. The graphite powder functions as a C supply source for forming carbides when the carbide precipitation type hard phase is used. In order to increase the strength of the matrix, the wear resistant sintered member should include 0.3 mass % or more of C, and 0.3 mass % or more of C should be added thereto as the graphite powder. When the amount of C is excessive, a hard and brittle FeC compound such as cementite is precipitated in the matrix, so that the strength and the wear resistance of the wear resistant sintered member are lowered. Therefore, when the silicide precipitation type hard phase is used, the upper limit of the amount of C should be 1.2 mass %. When the carbide precipitation type hard phase is used, the upper limit of the amount of C should be 2.0 mass %.

According to the above preferable composition of the matrix forming steel powder and the above preferable composition of the hard phase forming alloy powder, the preferable alloy composition of the wear resistant sintered member is as follows. For example, when the Fe base alloy matrix is used for the alloy matrix of the Mo silicide precipitation type hard phase and an iron sulfide powder is used for a sulfide powder, it is preferable that the wear resistant sintered member as a wear resistant sintered alloy include: 0.23 to 4.39 mass % of Ni; 0.62 to 22.98 mass % of Mo; 0.05 to 2.93 mass % of Cr; 0.18 to 3.79 mass % of Mn; 0.01 to 4.0 mass % of Si; 0.04 to 5.0 mass % of S; 0.3 to 1.2 mass % of C; and the balance of Fe and inevitable impurities. When a molybdenum disulfide powder is used in stead of iron sulfide powder in the above case, compositions supplied by decomposition of the sulfide powder are added to the matrix, whereby 0.13 to 6.86 mass % of Mo is added to the above composition, and the Mo contents in the overall composition is 0.75 to 29.84 mass %. When a tungsten disulfide powder or copper sulfide powder is used in stead of iron sulfide powder in the above case, 0.12 to 14.33 mass % of W or 0.08 to 9.91 mass % of Cu is added to the above composition.

When a Co base alloy is used for the alloy matrix of the Mo silicide precipitation dispersion hard phase and an iron sulfide powder is used for a sulfide powder, the wear resistant sintered member as a wear resistant sintered alloy preferably includes: 0.7 to 35.6 mass % of Co; 0.23 to 4.39 mass % of Ni; 0.62 to 22.98 mass % of Mo; 0.05 to 2.93 mass % of Cr; 0.18 to 3.79 mass % of Mn; 0.01 to 4.0 mass % of Si; 0.04 to 5.0 mass % of S; 0.3 to 1.2 mass % of S; and the balance of Fe and inevitable impurities. When a molybdenum disulfide powder is used in stead of iron sulfide powder in the above case, 0.13 to 6.86 mass % of Mo is added to the above composition, and the Mo contents in the overall composition is 0.75 to 29.84 mass %. When a tungsten disulfide powder or copper sulfide powder is used in stead of iron sulfide powder in the above case, 0.12 to 14.33 mass % of W or 0.08 to 9.91 mass % of Cu is added to the above composition.

When Cr carbide precipitation type hard phase is selected and an iron sulfide powder is used for a sulfide powder, the wear resistant sintered member as a wear resistant sintered alloy includes: 0.22 to 4.39 mass % of Ni; 0.22 to 4.88 mass % of Mo; 0.16 to 11.79 mass % of Cr; 0.18 to 3.79 mass % of Mn; 0.04 to 5.0 mass % of S; 0.3 to 2.0 mass % of C; at least one optionally additional element selected from a group consisting of 0.06 to 0.12 mass % of Mo; 0.004 to 0.88 mass % of V; 0.02 to 2.0 mass % of W; and the balance of Fe and inevitable impurities. When a molybdenum disulfide powder, a tungsten disulfide powder, or a copper sulfide powder is used as a sulfide powder, at least one element of 0.13 to 6.86 mass % of Mo, 0.12 to 14.33 mass % of W, and 0.08 to 9.91 mass % of Cu is added to the above overall composition.

When high speed steel type hard phase is selected and an iron sulfide powder is used as a sulfide powder, the wear resistant sintered member as a wear resistant sintered alloy includes: 0.22 to 4.39 mass % of Ni; 0.22 to 4.88 mass % of Mo; 0.14 to 3.79 mass % of Cr; 0.18 to 3.79 mass % of Mn; 0.02 to 8.0 mass % of W; 0.01 to 2.4 mass % of V; 0.04 to 5.0 mass % of S; 0.3 to 2.0 mass % of C; at least one optionally additional elements of not more than 8.0 mass % of Mo and not more than 8.0 mass % of Co; and the balance of Fe and inevitable impurities. When a molybdenum disulfide powder, a tungsten disulfide powder, or a copper sulfide powder is used as a sulfide powder, at least one element of 0.13 to 6.86 mass % of Mo, 0.12 to 14.33 mass % of W, and 0.08 to 9.91 mass % of Cu is added to the above overall composition.

As described above, 0.2 to 3 mass % of Mn is solid-solved in the matrix forming steel powder, 0.5 to 5 mass % of Mn is solid-solved in the hard phase forming alloy powder, and the sulfide powder for containing 0.04 to 5 mass % of S in the overall composition is supplied to the above powders with a graphite powder, the sulfide powder is decomposed in sintering and manganese sulfides are precipitated and dispersed in the matrix and the hard phase of the sintered member. As a result, particles of the manganese sulfides having a particle size of 10 μm or less are uniformly dispersed in the crystal grains of the overall matrix, and the particles of the manganese sulfides having a particle size of 10 μm or less are dispersed in the alloy matrix of the hard phase. In this case, amount of the dispersed particles of the manganese sulfide is 0.3 to 4.5 mass % in the wear resistant sintered member of the matrix and the hard phase, so that the machinability is improved.

In the wear resistant sintered member of the present invention, conventional techniques of adding materials for improving machinability can be used. For example, at least one selected from the group consisting of magnesium silicate mineral, boron nitride, manganese sulfide, calcium fluoride, bismuth, chrome sulfide, and lead can be dispersed in pores and powder boundaries. The above materials for improving machinability are chemically stable at high temperatures. Even if the powders of above materials for improving machinability are added to a raw material powder, the above materials are not decomposed in sintering and are dispersed in the above portion, so that the machinability of the wear resistant sintered member can be improved. By using the above techniques of adding materials for improving machinability, the machinability of the wear resistant sintered member can be improved greatly. When the above techniques of adding materials for improving machinability is used, the upper limit of amount of the above material for improving machinability should be 2.0 mass % in the wear resistant sintered member, since the strength of the wear resistant sintered member decreases when the above material for improving machinability is excessively added.

In the wear resistant sintered member of the present invention, as disclosed in Patent Publication 2, at least one selected from the group consisting of lead or lead alloy, copper or copper alloy, and aclylic resin can be filled in the pores of the wear resistant sintered member, so that the machinability can be improved. That is, when lead or lead alloy, copper or copper alloy, or aclylic resin exists in the pores, cutting is changed from intermittently cutting to sequential cutting in machining the wear resistant sintered member, and impact given to a cutting tool used in the machining is reduced, so that the damage to the edge of the cutting tool is prevented, and the wear resistant the machinability of the sintered member is improved. Since lead, lead alloy, copper and copper alloy are soft, these materials are adhered to the edge of the cutting tool, so that the edge of the cutting tool is protected, the machinability is improved, and the service life of the cutting tool is prolonged. Furthermore, in using the cutting tool, the above materials functions as a solid lubricant between a valve seat and a face surface of a valve, so that the wear of them can be reduced. Since copper and copper alloy has high thermal conductivity, heat generated in the edge of the cutting tool is dissipated to outside, store of heat in the edge portion of the cutting tool is prevented, and damage to the edge portion is reduced.

EMBODIMENTS

Embodiment 1

Matrix forming steel powders having compositions shown in Table 1 were prepared. A hard phase forming alloy powder having a composition consisting of 35% of Mo, 3% of Si, 2% of Mn, all by mass %, the balance of Fe and inevitable impurities, and a molybdenum disulfide powder having the maximum particle size of 100 μm and an average particle size of 50 μm, and a graphite powder were prepared. These powders were mixed at rates shown in Table 1 together with a forming lubricant (0.8 mass % of zinc stearate), and the mixed powder was formed into ring-shaped green compacts with an outer diameter of 30 mm, an inner diameter of 20 mm, and a height of 10 mm at a forming pressure of 650 MPa. Then, the green compacts were sintered at 1160° C. for 60 minutes in an decomposed ammonia gas atmosphere, and samples 01 to 06 having compositions shown in Table 2 were produced.

TABLE 1

| Sample No. | Mixing Ratio (mass %) | | | | | | | | | |
|---|---|---|---|---|---|---|---|---|---|---|
| | Matrix Forming Steel Powder | | | | | | Hard Phase Forming Alloy Powder | Graphite Powder | Sulfide Powder | |
| | Composition of Powder (mass %) | | | | | | | | | |
| | Fe | Ni | Mo | Cr | Mn | | (Fe—35Mo—3Si—2Mn) | | Type | |
| 01 | Balance | Balance | 1.60 | 1.00 | 0.20 | 0.00 | 5.00 | 1.00 | $MoS_2$ | 1.00 |
| 02 | Balance | Balance | 1.60 | 1.00 | 0.20 | 0.20 | 5.00 | 1.00 | $MoS_2$ | 1.00 |
| 03 | Balance | Balance | 1.60 | 1.00 | 0.20 | 0.50 | 5.00 | 1.00 | $MoS_2$ | 1.00 |
| 04 | Balance | Balance | 1.60 | 1.00 | 0.20 | 2.00 | 5.00 | 1.00 | $MoS_2$ | 1.00 |
| 05 | Balance | Balance | 1.60 | 1.00 | 0.20 | 3.00 | 5.00 | 1.00 | $MoS_2$ | 1.00 |
| 06 | Balance | Balance | 1.60 | 1.00 | 0.20 | 5.00 | 5.00 | 1.00 | $MoS_2$ | 1.00 |

The metal structure of the samples was observed and the rate of area occupied by precipitated manganese sulfides was measured, and the rate of the area was converted into mass percent. The values obtained by the conversion are shown in the column as "Amount of MnS" in Table 3.

Wear resistance of these samples were evaluated by simplified wear tests, and the results are shown in the column as "Wear Amount of Valve" and the column as "Wear Amount of Valve Seat" in Table 3, and the total wear amounts thereof are shown in the column as "Total Wear Amount" in Table 3. Machinability of the samples was evaluated by simplified machinability test, and results thereof are shown in the column as "Number of Drilled Holes" in Table 3.

The simplified wear tests were conducted in the loaded state of striking and sliding at a high temperature. More specifically, the ring-shaped test piece was processed into a valve seat shape having a slope of 45 degrees at the inner side, and the sintered alloy was press-fitted into a housing made of an aluminum alloy. A contacting member (valve) with the valve seat is made from SUH-36O, and an outer surface thereof partially has a slope of 45 degrees. The valve was driven by motor, and vertical piston motions were caused by rotation of an eccentric cam, and sloped sides of the sintered alloy and contacting member were repeatedly contacted. That is, valve motions are repeated actions of releasing motion of departing from the valve seat by the eccentric cam rotated by motor driving, and contacting motion on the valve seat by the valve spring, and vertical piston motions are performed. In this test, the contacting member was heated by a burner and the temperature was set to the sintered alloy temperature of 300° C., and strike operations in the simplified wear test were 2800 times/minute, and the duration was 15 hours. In this manner, wear amount of the valve seats and the valves after the tests were measured and evaluated.

The simplified machinability test was performed in such a way that the sample was worked to a 5 mm thick plate and a hole is drilled in the plate by a cemented carbide drill with a 3 mm diameter. The drilling was performed with a load of 5 kN and the number of the holes which could be drilled by one drill was counted. The machinability of the sample is evaluated to be good as the number of the drilled holes is large.

TABLE 2

| Sample No. | Overall Composition (mass %) | | | | | | | |
|---|---|---|---|---|---|---|---|---|
| | Fe | Ni | Mo | Cr | Mn | Si | C | S |
| 01 | Balance | 1.49 | 3.28 | 0.19 | 0.10 | 0.15 | 1.00 | 0.40 |
| 02 | Balance | 1.49 | 3.28 | 0.19 | 0.29 | 0.15 | 1.00 | 0.40 |
| 03 | Balance | 1.49 | 3.28 | 0.19 | 0.57 | 0.15 | 1.00 | 0.40 |
| 04 | Balance | 1.49 | 3.28 | 0.19 | 1.96 | 0.15 | 1.00 | 0.40 |
| 05 | Balance | 1.49 | 3.28 | 0.19 | 2.89 | 0.15 | 1.00 | 0.40 |
| 06 | Balance | 1.49 | 3.28 | 0.19 | 4.75 | 0.15 | 1.00 | 0.40 |

TABLE 3

| Sample No. | Evaluation Item | | | | |
|---|---|---|---|---|---|
| | Amount of MnS (mass %) | Wear Amount of Valve (μm) | Wear Amount of Valve Seat (μm) | Total Wear Amount (μm) | Number of Drilled holes |
| 01 | 0.17 | 2 | 85 | 87 | 8 |
| 02 | 0.48 | 2 | 82 | 84 | 36 |
| 03 | 0.96 | 2 | 80 | 82 | 60 |
| 04 | 1.00 | 3 | 81 | 84 | 62 |
| 05 | 1.01 | 4 | 83 | 87 | 55 |
| 06 | 1.00 | 15 | 108 | 123 | 43 |

Figure 3:
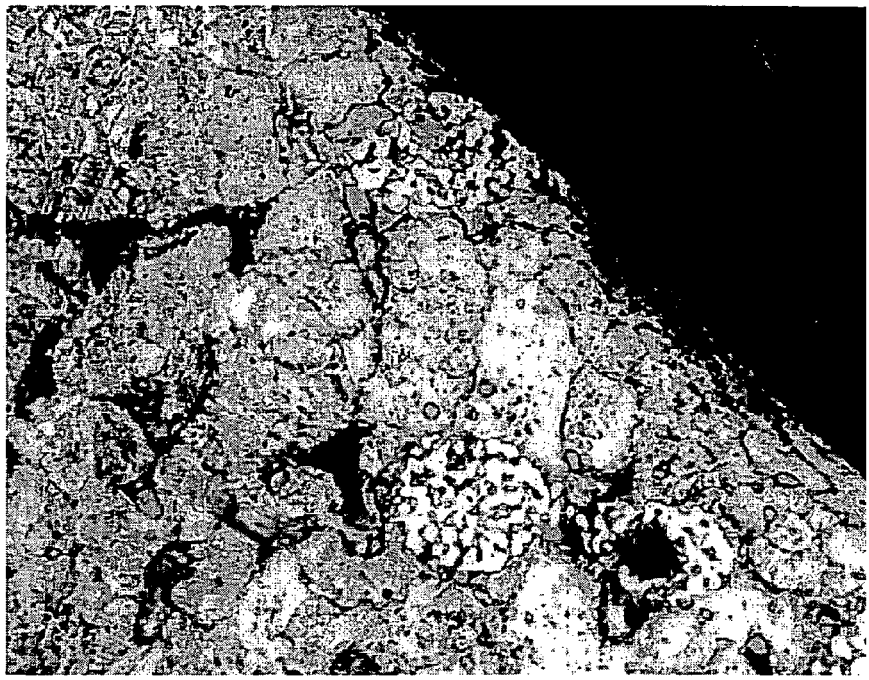
FIG. 3 is a microphotograph of a metal structure of a wear resistant sintered member of an embodiment according to the present invention.
Figure 4:
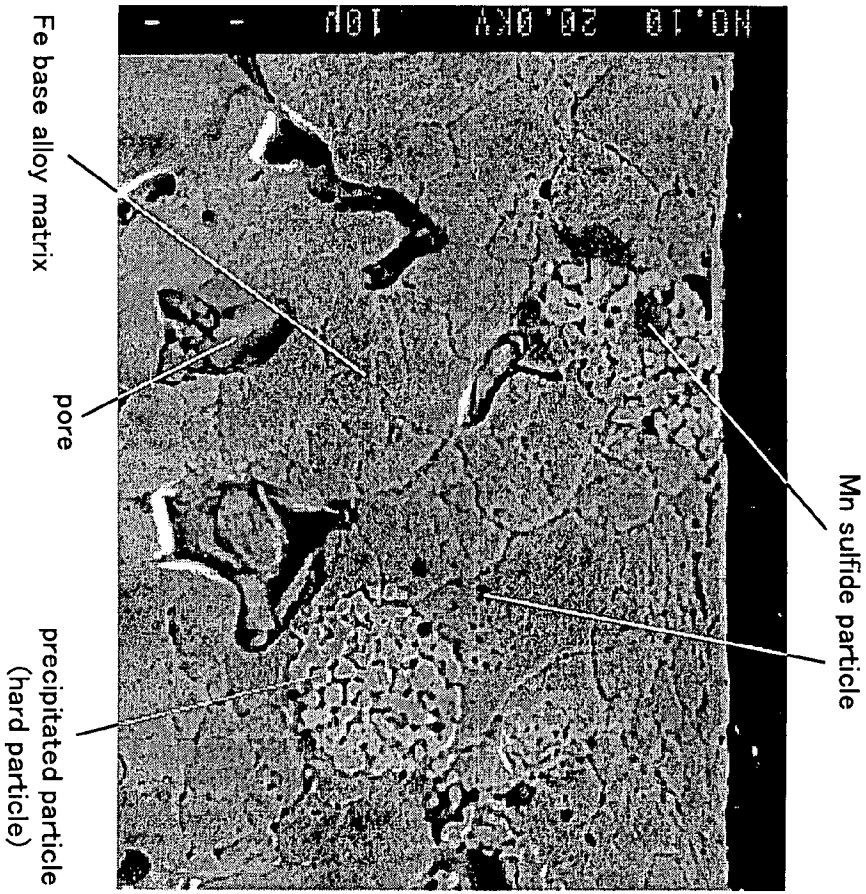
FIG. 4 is an electron microphotograph of a metal structure of a wear resistant sintered member of an embodiment according to the present invention.

Referring to sample 03 in Table 1, a microphotograph of a metal structure is shown in FIG. 3 and an electron microphotograph of a metal structure is shown in FIG. 4. In FIGS. 3 and 4, the portion showing a phase in which whitish fine particles agglomerate is a hard phase and the whitish fine particle is a particle of precipitated molybdenum silicide, and the clearance between the particles of molybdenum silicide is an alloy matrix of the hard phase. The gray particles are observed in the iron-based alloy matrix and the hard phase in FIGS. 3 and 4, and surface analysis was performed to the gray particle. As a result, it was confirmed that Mn and S are concentrated in the gray particle and manganese sulfides were formed therein. Furthermore, it was confirmed that molybdenum disulfide was decomposed in the sintering since the portion in which Mn is dispersed is not identical to the portion in which S is dispersed, and that S formed by the decomposition was selectively bonded with Mn which was added to the matrix. In addition, referring to the gauge in which the distance between two white lines showing "10 μ" is 10 μm in FIG. 4, it was confirmed that the particle size of the all gray manganese sulfides was fine with 10 μm or less. Referring to FIG. 3, it was confirmed that the iron-based matrix was bainite, and that circumference of the hard phase had partially different metal structure from other portion by diffusion of elements from the hard phase.

According to Tables 1 to 3, although amount of precipitated manganese sulfides was increased as the Mn content in the matrix forming steel powder was increased, amount of the precipitation of manganese sulfides was constant when the Mn content in the matrix forming steel powder was 2.0 mass % or more. The reason of such a result is mentioned as follows. That is, amount of S bonded with Mn was constant with 0.4 mass % in the overall composition as shown in Table 2, whereby amount of manganese sulfides formed by S and Mn was constant. Therefore, even if excessive Mn is included, manganese sulfides cannot be precipitated over specific amount. In this regard, excessive Mn may be solid-solved in the matrix in samples 05 and 06.

Therefore, although the wear amount of the valve seat was decreased as the Mn content in the matrix forming steel powder was increased, the wear amount of the valve seat was increased on the contrary when the Mn content was excessive and amount of Mn solid-solved in the matrix was increased and hardness thereof is increased. As is clearly shown by sample 06 in which the Mn content in the matrix forming steel powder was more than 5 mass %, because a large amount of Mn was solid-solved in the matrix forming steel powder, compactability of the powder was deteriorated and densities of the green compact and sintered body were decreased, whereby the strength of the matrix was lowered and wear amount of the valve seat was increased. Furthermore, hardness of the matrix was excessively increased and attack on the contacting member was increased, whereby the wear amount of the valve was increased and the total wear amount was drastically increased.

The machinability test (number of drilled holes) showed the same tendency as the above explained wear resistance. In sample 01 in which Mn was not contained in the matrix forming steel powder, manganese sulfides were not precipitated in the matrix, whereby the number of drilled hole was small and the machinability was not good. In contrast, in the samples in which not less than 0.2 mass % of Mn was contained in the matrix forming steel powder, manganese sulfides were precipitated in the matrix and the machinability was improved, whereby the number of drilled holes was greatly increased. Furthermore, amount of manganese sulfides precipitated in the matrix was increased as the Mn content in the matrix forming steel powder was increased, whereby the number of drilled hole was further increased. However, in sample 06 in which the Mn content in the matrix forming steel powder was more than 3.0 mass %, excessive Mn was solid-solved in the matrix, whereby the machinability was greatly lowered.

As explained above, it was confirmed that manganese sulfides were precipitated in the matrix, whereby machinability and wear resistance were improved when not less than 0.2 mass % of Mn is contained in the matrix forming steel powder. It was also confirmed that Mn was excessively solid-solved in the matrix, whereby machinability and wear resistance were deteriorated on the contrary when more than 3.0 mass % of Mn is contained in the matrix forming steel powder.

In the observation of the metal structure, it was confirmed that the size of all the manganese sulfides precipitated in the matrix was 10 μm or less in samples 01 to 06, and sulfides were uniformly dispersed in the matrix.

Embodiment 2

The matrix forming steel powder (Mn content: 0.5 mass %) used in sample 03 in Embodiment 1, 5 mass % of a hard phase forming alloy powder of which composition is shown in Table 4, 1.0 mass % of a graphite powder, and 1.0 mass % of a molybdenum disulfide powder having the maximum particle size of 100 μm and an average particle size of 50 μm were mixed together with a forming lubricant (0.8 mass % of zinc stearate). The mixed powder was processed with the same conditions as the embodiment 1, and samples 07 to 11 of which compositions are shown in Table 5 were produced. These samples were evaluated with the same conditions as the embodiment 1. The results of the evaluation are shown in Table 6. It should be noted that data of sample 03 in the embodiment 1 is shown together in Tables. 4 to 6.

TABLE 4

| Sample | Mixing Ratio (mass %) | | | | | | | | |
|---|---|---|---|---|---|---|---|---|---|
| | Matrix Forming Steel Powder | Hard Phase Forming Alloy Powder | | | | | Graphite | Sulfide Powder | |
| | | | Composition of Powder (mass %) | | | | | | |
| No. | (Fe—1.6Ni—1Mo—0.2Cr—0.5Mn) | | Fe | Mo | Si | Mn | Powder | Type | |
| 07 | Balance | 5.00 | Balance | 35.00 | 3.00 | — | 1.00 | $MoS_2$ | 1.00 |
| 08 | Balance | 5.00 | Balance | 35.00 | 3.00 | 0.50 | 1.00 | $MoS_2$ | 1.00 |
| 09 | Balance | 5.00 | Balance | 35.00 | 3.00 | 1.00 | 1.00 | $MoS_2$ | 1.00 |
| 03 | Balance | 5.00 | Balance | 35.00 | 3.00 | 2.00 | 1.00 | $MoS_2$ | 1.00 |
| 10 | Balance | 5.00 | Balance | 35.00 | 3.00 | 5.00 | 1.00 | $MoS_2$ | 1.00 |
| 11 | Balance | 5.00 | Balance | 35.00 | 3.00 | 7.00 | 1.00 | $MoS_2$ | 1.00 |

TABLE 5

| Sample | Overall Composition (mass %) | | | | | | | |
|---|---|---|---|---|---|---|---|---|
| No. | Fe | Ni | Mo | Cr | Mn | Si | C | S |
| 07 | Balance | 1.49 | 3.28 | 0.19 | 0.47 | 0.15 | 1.00 | 0.40 |
| 08 | Balance | 1.49 | 3.28 | 0.19 | 0.49 | 0.15 | 1.00 | 0.40 |
| 09 | Balance | 1.49 | 3.28 | 0.19 | 0.52 | 0.15 | 1.00 | 0.40 |
| 03 | Balance | 1.49 | 3.28 | 0.19 | 0.57 | 0.15 | 1.00 | 0.40 |

TABLE 5-continued

| Sample | Overall Composition (mass %) | | | | | | | |
|---|---|---|---|---|---|---|---|---|
| No. | Fe | Ni | Mo | Cr | Mn | Si | C | S |
| 10 | Balance | 1.49 | 3.28 | 0.19 | 0.72 | 0.15 | 1.00 | 0.40 |
| 11 | Balance | 1.49 | 3.28 | 0.19 | 0.82 | 0.15 | 1.00 | 0.40 |

TABLE 6

| | Evaluation Item | | | | |
|---|---|---|---|---|---|
| Sample No. | Amount of MnS (mass %) | Wear Amount of Valve (μm) | Wear Amount of Valve Seat (μm) | Total Wear Amount (μm) | Number of Drilled holes |
| 07 | 0.79 | 3 | 89 | 92 | 26 |
| 08 | 0.82 | 2 | 86 | 88 | 38 |
| 09 | 0.87 | 2 | 82 | 84 | 48 |
| 03 | 0.96 | 2 | 80 | 82 | 60 |
| 10 | 1.00 | 6 | 78 | 84 | 51 |
| 11 | 0.99 | 15 | 121 | 136 | 28 |

As shown in Tables 4 to 6, although amount of precipitated manganese sulfides was increased as the Mn content in the hard phase forming alloy powder was increased, amount of precipitated manganese sulfides was constant when the Mn content in the hard phase forming alloy powder was not less than 2.0 mass %. The result is similar to the embodiment 1. Because the S content was content in the overall composition in Table 5, Mn was excessive when the Mn content in the hard phase forming alloy powder was more than specific amount. Therefore, in samples 10 and 11, excessive Mn was solid-solved in the matrix.

The tendency of wear resistance is also similar to Embodiment 1. That is, wear amount of the valve seat was decreased as the Mn content in the hard phase forming alloy powder was increased. However, excessive Mn was solid-solved in the alloy matrix when Mn was contained more than specific amount. It was confirmed that attack on the contacting member (valve) was increased, whereby wear amount of the valve was increased, and total wear amount was increased when the Mn content was more than 5 mass %.

The tendency of machinability is also similar to Embodiment 1. In sample 07 (conventional art disclosed in Patent Publication 7) in which Mn was not contained in the hard phase forming alloy powder, manganese sulfide was not precipitated in the hard phase. Although total amount of manganese sulfides in sample 07 was not so different from that of sample 08, the number of drilled holes was small and the machinability was lowered. In contrast, in sample 08 in which 0.5 mass % of Mn was contained in the hard phase forming alloy powder, manganese sulfides were precipitated in the alloy matrix of the hard phase, whereby the machinability was improved and the number of drilled holes was increased. Amount of manganese sulfides was increased as the Mn content was increased, whereby the number of drilled holes was further increased. However, in sample 11 in which the Mn content in the hard phase forming alloy powder was more than 5 mass %, excessive Mn was solid-solved in the alloy matrix of the hard phase, whereby the machinability was greatly lowered.

As explained above, it was confirmed that machinability was improved compared to the conventional art disclosed in Patent Publication 7 by precipitating manganese sulfides also in the alloy matrix of the hard phase, and advantages of the invention was confirmed. Specifically, it was confirmed that although machinability and wear resistance were improved by containing not less than 0.5 mass % of Mn in the hard phase forming alloy powder, excessive Mn was solid-solved in the alloy matrix of the hard phase, whereby machinability and wear resistance were deteriorated on the contrary when more than 5 mass % of Mn was contained in the hard phase forming alloy powder.

In the observation of the metal structure of samples 07 to 11, it was confirmed that the size of all the manganese sulfides precipitated in the matrix was 10 μm or less, and the sulfides were uniformly dispersed in the matrix.

Embodiment 3

The matrix forming steel powder and the hard phase forming alloy powder used in sample 03 in Embodiment 1, 1.0 mass % of a graphite powder, and a molybdenum disulfide powder having the maximum particle size of 100 μm and an average particle size of 50 μm at amount shown in Table 7 were mixed together with a forming lubricant (0.8 mass % of zinc stearate). The mixed powder was processed with the same conditions as Embodiment 1, and samples 12 to 16 of which overall compositions are shown in Table 8 were produced. These samples were evaluated with the same conditions as Embodiment 1. The results of the evaluation are shown in Table 9. It should be noted that data of sample 03 in Embodiment 1 is shown together in Tables 7 to 9.

TABLE 7

| | Mixing Ratio (mass %) | | | | |
|---|---|---|---|---|---|
| Sample | Matrix Forming Steel Powder | Hard Phase Forming Alloy Powder | Graphite | Sulfide Powder | |
| No. | (Fe—1.6Ni—1Mo—0.2Cr—0.5Mn) | (Fe—35Mo—3Si—2Mn) | Powder | Type | |
| 12 | Balance | 5.00 | 1.00 | $MoS_2$ | 0.10 |
| 13 | Balance | 5.00 | 1.00 | $MoS_2$ | 0.50 |
| 03 | Balance | 5.00 | 1.00 | $MoS_2$ | 1.00 |
| 14 | Balance | 5.00 | 1.00 | $MoS_2$ | 7.50 |
| 15 | Balance | 5.00 | 1.00 | $MoS_2$ | 12.65 |
| 16 | Balance | 5.00 | 1.00 | $MoS_2$ | 15.00 |

TABLE 8

| Sample No. | Overall Composition (mass %) Fe | Ni | Mo | Cr | Mn | Si | C | S |
|---|---|---|---|---|---|---|---|---|
| 12 | Balance | 1.50 | 2.75 | 0.19 | 0.57 | 0.15 | 1.00 | 0.04 |
| 13 | Balance | 1.50 | 2.99 | 0.19 | 0.57 | 0.15 | 1.00 | 0.20 |
| 03 | Balance | 1.49 | 3.28 | 0.19 | 0.57 | 0.15 | 1.00 | 0.40 |
| 14 | Balance | 1.38 | 7.15 | 0.17 | 0.53 | 0.15 | 1.00 | 2.96 |
| 15 | Balance | 1.30 | 10.22 | 0.16 | 0.51 | 0.15 | 1.00 | 5.00 |
| 16 | Balance | 1.26 | 11.61 | 0.16 | 0.50 | 0.15 | 1.00 | 5.93 |

TABLE 9

| Sample No. | Sintering Temperature ° C. | Evaluation Item: Amount of MnS (mass %) | Wear Amount of Valve (μm) | Wear Amount of Valve Seat (μm) | Total Wear Amount (μm) | Number of Drilled holes |
|---|---|---|---|---|---|---|
| 28 | 1000 | 0.96 | 4 | 148 | 152 | 97 |
| 29 | 1100 | 0.96 | 2 | 88 | 90 | 76 |
| 03 | 1160 | 0.96 | 2 | 80 | 82 | 60 |
| 30 | 1200 | 0.96 | 3 | 78 | 81 | 52 |
| 31 | 1300 | 0.96 | 25 | 105 | 130 | 20 |

As shown in Tables 7 to 9, although amount of precipitated manganese sulfides was increased as amount of the molybdenum disulfide powder was increased, amount of precipitated manganese sulfides was constant when amount of molybdenum disulfide powder was not less than 1 mass %. Because amount of Mn in the matrix and the hard phase was approximately constant in the overall composition as shown in Table 8, even if the molybdenum disulfide powder was added in a condition in which the S amount exceeds the Mn amount, manganese sulfides could not be precipitated over the Mn amount.

However, it should be noted that the number of drilled holes was increased as amount of the molybdenum disulfide powder was increased, and there was no decrease of the number of drilled holes as shown in Embodiments 1 and 2. The reason of such a result is explained as follows.

Mn explained in Embodiments 1 and 2 is solid-solved in a matrix and increases hardness of the matrix, thereby deteriorating machinability. On the other hand, Mn forms manganese sulfides which improve machinability. Therefore, excessive Mn decrease or lose improvement of machinability by manganese sulfides. However, S does not have such a negative function. Excessive S forms sulfides with Cr which easily forms sulfides next to Mn, and Fe, Co, Ni, Mo, and the like which easily form sulfides next to Cr, thereby improving machinability.

Regarding wear resistance, it was confirmed that wear amount of the valve seat was decreased and good wear resistance was shown to the extent of the specific amount of the molybdenum disulfide powder. However, when amount of the molybdenum disulfide powder exceeded the specific amount, wear amount of the valve seat was gradually increased. When amount of the molybdenum disulfide powder was more than 12.65 mass % (S content in the overall composition was 5 mass %), the strength of the matrix was lowered and radical wear occurred.

As explained above, it was confirmed that although machinability and wear resistance were improved by adding a sulfide powder containing not less than 0.2 mass % of S in overall composition, the strength of the matrix was lowered and wear resistance deteriorated when a sulfide powder containing more than 5 mass % of S in overall composition was added.

In the observation of the metal structure of samples 12 to 15, it was confirmed that the size of all the manganese sulfides precipitated in the matrix was 10 μm or less, and sulfides were uniformly dispersed in the matrix.

Embodiment 4

The matrix forming steel powder used for samples 02 and 05 in Embodiment 1 and a matrix forming steel powder of which composition was identical to that of the above matrix forming steel powder except that Mn was not contained were prepared. The hard phase forming alloy powder used for samples 08 and 10 in Embodiment 2 and a hard phase forming alloy powder of which composition was identical to that of the above hard phase forming alloy powder except that Mn was not contained were prepared. These powders were mixed with 1.0 mass % of a graphite powder, and a molybdenum disulfide powder having the maximum particle size of 100 μm and an average particle size of 50 μm at amount shown in Table 10 together with a forming lubricant (0.8 mass % of zinc stearate). The mixed powder was processed with the same conditions as Embodiment 2, and samples 17 to 19 of which overall compositions are shown in Table 11 were produced. These samples were evaluated with the same conditions as Embodiment 1. The results of the evaluation are shown in Table 12.

TABLE 10

| Sample No. | Mixing Ratio (mass %): MatrixForming Steel Powder (Fe—1.6Ni—0.2Cr—xMn) | Mn | Hard Phase Forming Alloy Powder (Fe—35Mo—3Si—xMn) | Mn | Graphite Powder | Sulfide Powder Type | |
|---|---|---|---|---|---|---|---|
| 17 | Balance | — | 5.00 | — | 1.00 | — | — |
| 18 | Balance | 0.20 | 5.00 | 0.50 | 1.00 | $MoS_2$ | 0.50 |
| 19 | Balance | 3.00 | 5.00 | 5.00 | 1.00 | $MoS_2$ | 12.65 |

TABLE 11

| Sample | Overall Composition (mass %) | | | | | | | |
|---|---|---|---|---|---|---|---|---|
| No. | Fe | Ni | Mo | Cr | Mn | Si | C | S |
| 17 | Balance | 1.50 | 2.69 | 0.19 | — | 0.15 | 1.00 | — |
| 18 | Balance | 1.50 | 2.99 | 0.19 | 0.21 | 0.15 | 1.00 | 0.20 |
| 19 | Balance | 1.30 | 10.22 | 0.16 | 2.69 | 0.15 | 1.00 | 5.00 |

TABLE 12

| | Evaluation Item | | | | |
|---|---|---|---|---|---|
| Sample No. | Amount of MnS (mass %) | Wear Amount of Valve (μm) | Wear Amount of Valve Seat (μm) | Total Wear Amount (μm) | Number of Drilled holes |
| 17 | — | 7 | 108 | 115 | 5 |
| 18 | 0.30 | 2 | 86 | 88 | 20 |
| 19 | 4.50 | 5 | 92 | 97 | 164 |

Sample 18 included the matrix forming steel powder and the hard phase forming alloy powder containing the minimum amount of Mn and the minimum amount of sulfide powder in Embodiments 1 to 3. Sample 17 included the matrix forming steel powder and hard phase forming alloy powder which did not contain Mn respectively, and did not include a sulfide powder. As shown in Tables 10 to 12, amount of precipitated manganese sulfides was 0.3 mass % in sample 18, this amount was enough to improve wear resistance and machinability (number of drilled holes) compared to sample 17 in which manganese sulfides were not dispersed, and thus the advantages of the invention were confirmed. Sample 19 included the matrix forming steel powder and the hard phase forming alloy powder containing the maximum amount of Mn and the maximum amount of sulfide powder in Embodiments 1 to 3. Although amount of precipitated manganese sulfides was high with 4.5 mass % in sample 19, it was confirmed that the wear resistance of sample 19 was not lowered as was shown in samples in which each element was excessive, and the machinability in sample 19 was superior.

Embodiment 5

The matrix forming steel powder used for sample 03 in Embodiment 1 and hard phase forming alloy powders of which compositions are shown in Table 13 were prepared. These powders were mixed with 1.0 mass % of a graphite powder, and a molybdenum disulfide powder having the maximum particle size of 100 μm and an average particle size of 50 μm at amount as shown in Table 13 together with a forming lubricant (0.8 mass % of zinc stearate). The mixed powder was processed with the same conditions as Embodiment 1, and samples 20 to 22 of which overall compositions are shown in Table 14 were produced. These samples were evaluated with the same conditions as Embodiment 1. The results of the evaluation are shown in Table 15. Data of sample 03 in Embodiment 1 and data of sample 17 (example in which manganese sulfides were not dispersed) in Embodiment 4 are shown together in Tables 13 to 15 for comparison.

It should be noted that the hard phase forming alloy powder used for sample 20 is an example in which Fe is changed to Co as a base metal in the hard phase forming alloy powder used for sample 03, and the hard phase forming alloy powder forms a hard phase in which Mo silicide is precipitated and dispersed in a Co alloy phase. The hard phase forming alloy powder used for sample 21 is an example of Cr carbides precipitation type hard phase. The hard phase forming alloy powder used for sample 22 is an example of a high speed steel type hard phase (in which W, Mo, or Cr carbide is precipitated).

TABLE 13

| Sample | Mixing Ratio (mass %) | | | | | | | |
|---|---|---|---|---|---|---|---|---|
| | Matrix Forming Steel Powder | | Hard Phase Forming Alloy Powder | | Graphite | Sulfide Powder | |
| No. | | Composition of Powder | | Composition of Powder | Powder | Type | |
| 17 | Balance | Fe—1.6Ni—1Mo—0.2Cr | 5.00 | Fe—35Mo—3Si | 1.00 | — | — |
| 03 | Balance | Fe—1.6Ni—1Mo—0.2Cr—0.5Mn | 5.00 | Fe—35Mo—3Si—2Mn | 1.00 | $MoS_2$ | 1.00 |
| 20 | Balance | Fe—1.6Ni—1Mo—0.2Cr—0.5Mn | 5.00 | Co—35Mo—3Si—2Mn | 1.00 | $MoS_2$ | 1.00 |
| 21 | Balance | Fe—1.6Ni—1Mo—0.2Cr—0.5Mn | 5.00 | Fe—12Cr—1Mo—0.5V—1.4C—2Mn | 1.00 | $MoS_2$ | 1.00 |
| 22 | Balance | Fe—1.6Ni—1Mo—0.2Cr—0.5Mn | 5.00 | Fe—4Cr—10Mo—10W—3V—1.4C—2Mn | 1.00 | $MoS_2$ | 1.00 |

TABLE 14

| Sample | Overall Composition (mass %) | | | | | | | | | | |
|---|---|---|---|---|---|---|---|---|---|---|---|
| No. | Fe | Co | Ni | Mo | Cr | Mn | Si | C | V | W | S |
| 17 | Balance | — | 1.50 | 2.69 | 0.19 | 0.00 | 0.15 | 1.00 | — | — | 0.00 |
| 03 | Balance | — | 1.49 | 3.28 | 0.19 | 0.57 | 0.15 | 1.00 | — | — | 0.40 |
| 20 | — | Balance | 1.49 | 3.28 | 0.19 | 0.57 | 0.15 | 1.00 | — | — | 0.40 |
| 21 | Balance | — | 1.49 | 1.58 | 0.79 | 0.57 | 0.00 | 1.07 | 0.03 | — | 0.40 |
| 22 | Balance | — | 1.49 | 2.03 | 0.39 | 0.57 | 0.00 | 1.07 | 0.15 | 0.50 | 0.40 |

TABLE 15

| Sample No. | Evaluation Item: Amount of MnS (mass %) | Wear Amount of Valve (μm) | Wear Amount of Valve Seat (μm) | Total Wear Amount (μm) | Machinability |
|---|---|---|---|---|---|
| 17 | — | 7 | 108 | 115 | 5 |
| 03 | 0.96 | 2 | 80 | 82 | 60 |
| 20 | 0.97 | 2 | 65 | 67 | 55 |
| 21 | 0.95 | 1 | 95 | 96 | 65 |
| 22 | 0.96 | 4 | 90 | 94 | 50 |

As shown in Tables 13 to 15, samples 20 to 22 showed high wear resistance and superior machinability without regard to kind of the hard phase compared to sample 17 in which manganese sulfides were not dispersed, and showed approximately the same properties. Therefore, it was confirmed that the invention in which Mn was contained in the hard phase and manganese sulfides were precipitated and dispersed in the alloy matrix of the hard phase could improve machinability and wear resistance in not only the hard phase in which molybdenum silicide was precipitated and dispersed in the Fe matrix as in Embodiments 1 to 4 but also in the hard phase in which other precipitates were precipitated and dispersed.

Embodiment 6

The matrix forming steel powder and the hard phase forming alloy powders used for sample 03 in Embodiment 1 and a graphite powder were prepared. A tungsten disulfide powder, an iron sulfide powder, and copper sulfide powder as a sulfide powder were prepared. These powders were mixed at rates shown in Table 16 together with a forming lubricant (0.8 mass % of zinc stearate). The mixed powder was processed with the same conditions as Embodiment 1, and samples 23 to 25 of which overall compositions are shown in Table 17 were produced. These samples were evaluated with the same conditions as Embodiment 1. The results of the evaluation are shown in Table 18. Data of sample 03 in which molybdenum sulfide was used as a sulfide powder in Embodiment 1 is shown together in Tables 16 to 18. In Embodiment 6, amount of sulfide powder was adjusted such that the S content in the overall composition was 0.4 mass %.

TABLE 16

| Sample No. | Mixing Ratio (mass %): Matrix Forming Steel Powder (Fe—1.6Ni—1Mo—0.2Cr—0.5Mn) | Hard Phase Forming Alloy Powder (Fe—35Mo—3Si—2Mn) | Graphite Powder | Sulfide Powder Type | Sulfide Powder |
|---|---|---|---|---|---|
| 03 | Balance | 5.00 | 1.00 | $MoS_2$ | 1.00 |
| 23 | Balance | 5.00 | 1.00 | $WS_2$ | 1.55 |
| 24 | Balance | 5.00 | 1.00 | FeS | 1.10 |
| 25 | Balance | 5.00 | 1.00 | CuS | 1.19 |

TABLE 17

| Sample No. | Overall Composition (mass %): Fe | Ni | Mo | Cr | Mn | Si | C | W | Cu | S |
|---|---|---|---|---|---|---|---|---|---|---|
| 03 | Balance | 1.49 | 3.28 | 0.19 | 0.57 | 0.15 | 1.00 | — | — | 0.40 |
| 23 | Balance | 1.48 | 2.67 | 0.18 | 0.56 | 0.15 | 1.00 | 1.15 | — | 0.40 |
| 24 | Balance | 1.49 | 2.68 | 0.19 | 0.56 | 0.15 | 1.00 | — | — | 0.40 |
| 25 | Balance | 1.48 | 2.68 | 0.19 | 0.56 | 0.15 | 1.00 | — | 0.73 | 0.40 |

TABLE 18

| Sample No. | Evaluation Item: Amount of MnS (mass %) | Wear Amount of Valve (μm) | Wear Amount of Valve Seat (μm) | Total Wear Amount (μm) | Number of Drilled holes |
|---|---|---|---|---|---|
| 03 | 0.96 | 2 | 80 | 82 | 60 |
| 23 | 0.95 | 3 | 78 | 81 | 55 |
| 24 | 0.95 | 2 | 95 | 97 | 63 |
| 25 | 0.96 | 3 | 90 | 93 | 52 |

Metal structures in samples 23 to 25 were observed. Although sulfide powder was changed from molybdenum disulfide powder to tungsten disulfide powder, iron sulfide powder, or copper sulfide powder, it was confirmed that manganese sulfides were precipitated and dispersed in the matrix and alloy matrix of the hard phase similarly to the case of the molybdenum disulfide powder. Furthermore, it was confirmed that the size of all the manganese sulfides were fine with 10 μm or less.

As shown in Tables 16 to 18, since amount of the sulfide powder was adjusted such that the S content in the overall composition was 0.4 mass %, amounts of precipitated manganese sulfides were approximately the same, and every samples showed good machinability and wear resistance. Therefore, it was confirmed that effective sulfide powder for precipitation of manganese sulfides is not limited to molybdenum disulfide powder and tungsten disulfide powder, iron sulfide powder, and copper sulfide powder provided good machinability and wear resistance. It is mentioned that sulfide powder which is easily decomposed has the same functions as the above sulfide powders.

Embodiment 7

The same powders used for sample 03 in Embodiment 1 except that particle size of the molybdenum disulfide powder was changed as shown in Table 19 were prepared and mixed. The mixed powder was processed with the same conditions as Embodiment 1, and samples 26 to 27 consisting of all by mass %, 1.49% of Ni, 3.28% of Mo, 0.19% of Cr, 0.57% of Mn, 0.15% of Si, 1% of C, 0.4% of S, the balance of Fe and inevitable impurities. These samples were evaluated with the same conditions as Embodiment 1. The results of the evaluation are shown in Table 20. Data of sample 03 in Embodiment 1 is shown together in Tables 19 to 20.

TABLE 19

| | Mixing Ratio (mass %) | | | | | | |
|---|---|---|---|---|---|---|---|
| | | | | Sulfide Powder | | | |
| Sample No. | Matrix Forming Steel Powder (Fe—1.6Ni—1Mo—0.2Cr—0.5Mn) | Hard Phase Forming Alloy Powder (Fe—35Mo—3Si—2Mn) | Graphite Powder | Type | Maximum Particle Diameter (μm) | Average Particle Diameter (μm) | |
| 26 | Balance | 5.00 | 1.00 | $MoS_2$ | 75 | 45 | 1.00 |
| 03 | Balance | 5.00 | 1.00 | $MoS_2$ | 100 | 50 | 1.00 |
| 27 | Balance | 5.00 | 1.00 | $MoS_2$ | 150 | 100 | 1.00 |

TABLE 20

| | Evaluation Item | | | | |
|---|---|---|---|---|---|
| Sample No. | Amount of MnS (mass %) | Wear Amount of Valve (μm) | Wear Amount of Valve Seat (μm) | Total Wear Amount (μm) | Number of Drilled holes |
| 26 | 0.96 | 2 | 80 | 82 | 80 |
| 03 | 0.96 | 2 | 80 | 82 | 60 |
| 27 | 0.41 | 3 | 92 | 95 | 28 |

As shown in Tables 19 and 20, the sulfide powder was sufficiently decomposed and the machinability and the wear resistance were good when the maximum particle size of the sulfide powder was 100 μm or less and the average particle size was 50 μm or less. However, in sample 27 in which sulfide powder having particle size exceeding the maximum particle size of 100 μm and the average particle size of 50 μm was used, amount of manganese sulfide was decreased. Therefore, it is mentioned that decomposition of the sulfide powder was insufficient in sample 27. In sample 27, wear resistance was not sufficiently improved and wear amount of the valve seat was increased, and machinability was not sufficiently improved and the number of drilled holes was greatly decreased. Therefore, it was confirmed that the added sulfide powder precipitated by decomposed and manganese sulfides were sufficiently precipitated by using sulfide powder having the maximum particle size of 100 μm and the average particle size of 50 μm or less.

What is claimed is:

1. A wear resistant sintered member comprising:

an Fe base alloy matrix; and a hard phase dispersed in the Fe base alloy matrix, wherein the hard phase has an alloy matrix and hard particles precipitated and dispersed in the alloy matrix;

wherein manganese sulfide particles having particle size of 10 μm or less are uniformly dispersed in crystal grains of the overall Fe base alloy matrix; and manganese sulfide particles having particle size of 10 μm or less are dispersed in the alloy matrix of the hard phase.

2. The wear resistant sintered member according to claim 1, wherein the wear resistant sintered member including 0.3 to 4.5 mass % of the manganese sulfide particles in the Fe base alloy matrix and the alloy matrix of the hard phase.

3. The wear resistant sintered member according to claim 1, wherein the Fe base alloy matrix includes 0.2 to 3 mass % of Mn, and the hard phase includes 0.5 to 5 mass % of Mn.

4. The wear resistant sintered member according to claim 3, wherein amount of Mn in the hard phase is larger than amount of Mn in the Fe base alloy matrix.

5. The wear resistant sintered member according to claim 1, wherein the wear resistant sintered member includes 2 to 40 mass % of the hard phase dispersed in the Fe base alloy matrix.

6. The wear resistant sintered member according to claim 1, wherein the Fe base alloy matrix has a structure composed of bainite.

7. The wear resistant sintered member according to claim 1, wherein the alloy matrix is composed of Fe base alloy or Co base alloy, and the hard particles of the hard phase are composed of molybdenum silicide.

8. The wear resistant sintered member according to claim 1, wherein the wear resistant sintered member is composed of a sintered alloy including: 0.23 to 4.39 mass % of Ni; 0.62 to 22.98 mass % of Mo; 0.05 to 2.93 mass % of Cr; 0.18 to 3.79 mass % of Mn; 0.01 to 4.0 mass % of Si; 0.04 to 5.0 mass % of S; 0.3 to 1.2 mass % of C; and the balance of Fe and inevitable impurities.

9. The wear resistant sintered member according to claim 1, wherein the wear resistant sintered member is composed of a sintered alloy including: 0.23 to 4.39 mass % of Ni; 0.62 to 29.84 mass % of Mo; 0.05 to 2.93 mass % of Cr; 0.18 to 3.79 mass % of Mn; 0.01 to 4.0 mass % of Si; 0.04 to 5.0 mass % of S; 0.3 to 1.2 mass % of C; optionally including at least one element selected from a group consisting of 0.12 to 14.33 mass % of W; and 0.08 to 9.91 mass % of Cu; and the balance of Fe and inevitable impurities.

10. The wear resistant sintered member according to claim 1, wherein the wear resistant sintered member is composed of a sintered alloy including: 0.7 to 35.6 mass % of Co; 0.23 to 4.39 mass % of Ni; 0.62 to 22.98 mass % of Mo; 0.05 to 2.93 mass % of Cr; 0.18 to 3.79 mass % of Mn; 0.01 to 4.0 mass % of Si; 0.04 to 5.0 mass % of S; 0.3 to 1.2 mass % of C; and the balance of Fe and inevitable impurities.

11. The wear resistant sintered member according to claim 1, wherein the wear resistant sintered member is composed of a sintered alloy including: 0.7 to 35.6 mass % of Co; 0.23 to 4.39 mass % of Ni; 0.62 to 29.84 mass % of Mo; 0.05 to 2.93 mass % of Cr; 0.18 to 3.79 mass % of Mn; 0.01 to 4.0 mass % of Si; 0.04to 5.0 mass % of 5; 0.3 to 1.2 mass % of C; optionally including at least one element selected from a group consisting of 0.12 to 14.33 mass % of W; and 0.08 to 9.91 mass % of Cu; and the balance of Fe and inevitable impurities.

12. The wear resistant sintered member according to claim 1, wherein the wear resistant sintered member is composed of a sintered alloy including: 0.22 to 4.39 mass % of Ni; 0.22 to 4.88 mass % of Mo; 0.16 to 11.79 mass % of Cr; 0.18 to 3.79 mass % of Mn; 0.04 to 5.0 mass % of S; 0.3 to 2.0 mass % of C; and the balance of Fe and inevitable impurities.

13. The wear resistant sintered member according to claim 1, wherein the wear resistant sintered member is composed of a sintered alloy including 0.22 to 4.39 mass % of Ni; 0.22 to 5.00 mass % of Mo; 0.16 to 11.79 mass % of Cr; 0.18 to 3.79 mass % of Mn; 0.04 to 5.0 mass % of S; 0.3 to 2.0 mass % of C; optionally including at least one element selected from a group consisting of 0.004 to 0.88 mass % of V; and 0.02 to 2.0 mass % of W; and the balance of Fe and inevitable impurities.

14. The wear resistant sintered member according to claim 1, wherein the wear resistant sintered member is composed of a sintered alloy including: 0.22 to 4.39 mass % of Ni; 0.22 to 11.74 mass % of Mo; 0.16 to 11.79 mass % of Cr; 0.18 to 3.79 mass % of Mn; 0.04 to 5.0 mass % of S; 0.3 to 2.0 mass % of C; optionally including at least one element selected from a group consisting of 0.12 to 14.33 mass % of W; and 0.08 to 9.91 mass % of Cu; and the balance of Fe and inevitable impurities.

15. The wear resistant sintered member according to claim 1, wherein the wear resistant sintered member is composed of a sintered alloy including: 0.22 to 4.39 mass % of Ni; 0.22 to 4.88 mass % of Mo; 0.14 to 3.79 mass % of Cr; 0.18 to 3.79 mass % of Mn; 0.02 to 8.0 mass % of W; 0.01 to 2.4 mass % of V; 0.04 to 5.0 mass % of S; 0.3 to 2.0 mass % of C; and the balance of Fe and inevitable impurities.

16. The wear resistant sintered member according to claim 1, wherein the wear resistant sintered member is composed of a sintered alloy including: 0.22 to 4.39 mass % of Ni; 0.22 to 12.88 mass % of Mo; 0.14 to 3.79 mass % of Cr; 0.18 to 3.79 mass % of Mn; 0.02 to 8.0 mass % of W; 0.01 to 2.4 mass % of V; 0.04 to 5.0 mass % of S; 0.3 to 2.0 mass % of C; optionally including not more than 8.0 mass % of Co and the balance of Fe and inevitable impurities.

17. The wear resistant sintered member according to claim 1, wherein the wear resistant sintered member is composed of a sintered alloy including: 0.22 to 4.39 mass % of Ni; 0.22 to 11.74 mass % of Mo; 0.14 to 3.79 mass % of Cr; 0.18 to 3.79 mass % of Mn; 0.02to 8.0 mass % of W; 0.01 to 2.4 mass % of V; 0.04 to 5.0 mass % of S; 0.3 to 2.0 mass % of C; optionally including 0.08 to 9.91 mass % of Cu; and the balance of Fe and inevitable impurities.

18. The wear resistant sintered member according to claim 1, wherein the wear resistant sintered member has pores and powder boundaries, and at least one selected from the group consisting of magnesium silicate mineral, boron nitride, manganese sulfide, calcium fluoride, bismuth, chrome sulfide, and lead is dispersed in the pores and the powder boundaries.

19. The wear resistant sintered member according to claim 1, wherein the wear resistant sintered member has pores, and one selected from the group consisting of lead or lead alloy, copper or copper alloy, and aclylic resin is filled in the pores.

* * * * *